US005815887A

United States Patent [19]

Nauthe et al.

[11] Patent Number: 5,815,887

[45] **Date of Patent: *Oct. 6, 1998**

[54] AIR-ASSISTED INTRODUCTION OF FIBER SLIVER BEFORE THE NIP OF CALENDAR DISKS

[75] Inventors: Alfred Nauthe, Böhmfeld; Wolfgang Göhler, Lenting, both of Germany

[73] Assignee: Rieter Ingolstadt Spinnereimaschinenbau AG, Ingolstadt, Germany

[ * ] Notice: The term of this patent shall not extend beyond the expiration date of Pat. Nos. 5,666,698 and 5,680,678.

[21] Appl. No.: 841,926

[22] Filed: Apr. 8, 1997

Related U.S. Application Data

[63] Continuation of Ser. No. 628,036, Apr. 4, 1996, Pat. No. 5,666,698.

[30] Foreign Application Priority Data

| | | | |
|---|---|---|---|
| Apr. 7, 1995 | [DE] | Germany | 295-06-107.3 |
| Jul. 25, 1995 | [DE] | Germany | 295-11-992.6 |
| Sep. 22, 1995 | [DE] | Germany | 195-35-300.5 |

[51] Int. Cl.[6] ..... D01H 5/72; D01H 13/04; D01G 15/46

[52] U.S. Cl. ..... 19/150; 19/157

[58] Field of Search ..... 19/150, 157

[56] References Cited

U.S. PATENT DOCUMENTS

| | | | |
|---|---|---|---|
| 614,819 | 11/1898 | Albasini . | |
| 2,996,873 | 8/1961 | Armstrong . | |
| 4,372,010 | 2/1983 | Gauvain . | |
| 4,575,903 | 3/1986 | Gauvain . | |
| 4,763,387 | 8/1988 | Bothner . | |
| 4,922,580 | 5/1990 | Bothner et al. . | |
| 4,949,431 | 8/1990 | Gasser . | |
| 5,016,322 | 5/1991 | Erni et al. . | |
| 5,412,846 | 5/1995 | Hauner . | |
| 5,666,698 | 9/1997 | Nauthe et al. | 19/157 |
| 5,680,678 | 10/1997 | Nauthe et al. | 19/157 |

FOREIGN PATENT DOCUMENTS

| | | |
|---|---|---|
| 801254 | 11/1950 | Germany . |
| 2623400 | 3/1977 | Germany . |
| 290679 | 12/1989 | Germany . |
| 406508 | 3/1934 | United Kingdom . |
| 632266 | 11/1949 | United Kingdom . |
| 786528 | 11/1957 | United Kingdom . |

*Primary Examiner*—John J. Calvert
*Attorney, Agent, or Firm*—Dority & Manning

[57] ABSTRACT

A process and device are provided to introduce a fiber fleece through the nip of a pair of calendar rollers. Pressurized air is directed to a cylindrical segment of a sliver guiding system down stream from a tapered conical section so that the pressurized air draws the fiber fleece through the sliver guiding system without requiring lateral venting or expansion of the pressurized air. The pressurized air vents from the front end of the cylindrical section adjacent the nip of the pair of calendar rollers.

7 Claims, 4 Drawing Sheets

AIR-ASSISTED INTRODUCTION OF FIBER SLIVER BEFORE THE NIP OF CALENDAR DISKS

This is a continuation of application Ser. No. 08/628,036 filed Apr. 4, 1996, now U.S. Pat. No. 5,666,698.

BACKGROUND OF THE INVENTION

The area of technical application of the invention is that of textile machines. In this area, the machine involved is in particular a draw frame with calendar equipment following the drafting equipment, consisting usually of two calendar disks facing each other by means of which the fiber sliver is compressed. Both are described in DE 295 10 871 U1 of Jul. 5, 1995. This patent refers to the full contents of this patent application.

As a rule several fiber slivers are doubled into one single fiber sliver before the drafting equipment. The doubled fiber sliver is conveyed into the drafting equipment. During the drafting process, the fiber sliver is spread out into a fiber fleece and is conveyed in this condition from by the pair of delivery rollers of the drafting equipment. The fiber fleece must be formed again into a fiber sliver. This is done by means of the fleece funnel. As the fiber fleece enters the inlet of the fleece funnel, a fiber sliver is formed again.

In the state of the art it is known that a pair of delivery rollers is provided at the output of drafting equipment of a draw-frame (e.g. a fiber processing machine) which conveys this fiber fleece into a fleece funnel. The fiber fleece is gathered together in the fleece funnel and is formed back into a fiber sliver and is conveyed to a fiber sliver channel having a considerable length. At the end of the fiber sliver channel, the fiber sliver is introduced into a fiber sliver funnel which deflects the direction of travel of the fiber sliver by approximately 90° and introduces it between a pair of calendar rollers (calendar disks). Once the fiber sliver has run through the pair of calendar rollers, the fiber sliver which has been compressed therein is conveyed on to the depositing device of the draw frame (see also e.g. EP 593 884 A1, U.S. Pat. No. 4,372,010 or DE-A, 26 23 400).

In DD 290 679 the fleece funnel and the sliver funnel are at a considerable distance above a fiber sliver channel. A venting opening (13 therein) allows the air which flows in at the beginning of the collection channel (therein 5) to escape completely before the narrowest point of the sliver funnel in order to build up again a suction stream shortly thereafter which is built up with inflowing compressed air by an injection bore in the fleece channel segment with the smallest diameter.

OBJECTS AND SUMMARY OF THE INVENTION

The invention has as a principal object to bring the beginning of the fiber fleece automatically into the fiber sliver channel between the delivery rollers and the calendar disks and to deposit it directly in front of the nip of the calendar disks, in particular in a manner that is economical of the conveying air. Additional objects and advantages of the invention are set forth in part in the following description, or may be obvious from the description, or may be learned through practice of the invention.

The process according to the invention avoids lateral escape of an air stream which is conveyed in the lateral air-tight guiding channel through at least two nozzle segments of the fiber sliver guiding system. The conveying air which is conveyed free of loss is produced via injection bores which are provided in the cylindrical segment of the sliver funnel, shortly before the nip of the calendar disks, whereby the above-mentioned cylindrical segment merges into a pointed end of the sliver funnel which is located immediately before the nip. The diameter of the cylindrical segment is here considerably smaller than the width of the calendar disks which are calendaring the fiber sliver fed to them.

Hereinafter mention is made of a pair of calendar disks or of the calendar disks, and this term also covers a pair of calendar rollers. This is possible because the invention excludes neither a pair of calendar disks nor a pair of calendar rollers.

The diameter of the cylindrical segment may be less than one third of the width of the calendar disks or, expressed differently, the calendar disks are at least three times wider than the diameter of the narrowest segment of the sliver funnel.

The process functions with a closed nip as well as with an open nip.

In order to enable the sliver funnel and its guiding channel to be placed very close to the nip, the forward end tapers to a point and ends in a line; curved surface segments of the forward end of the sliver funnel which are adapted to the curvature of the surface of the calendar disks also end in this line. The pointed end can correspond to the width of the nip.

Faster and more reliable preparation is ensured through the invention due to the elimination of the long fiber sliver channel of the state of the art, so that the fleece funnel and sliver funnel can be installed directly one after the other. This is the guiding system.

It now becomes possible to accelerate and simplify preparation, i.e. the introduction of the drafted fiber sliver, and to reduce air losses as much as possible. Thanks to the elimination of the fiber sliver channel, the fiber sliver guiding system according to the invention becomes particularly short and compact. Long distances, and thereby technologically undesirable dead times, can be reduced. In spite of its compact construction, the fiber guiding system is easy to handle and even allows for two positions of the interlocking nozzles via the air-tight articulation, one for normal operation and one for preparation. Surprisingly, the compact fiber sliver guiding system can be adjusted easily and is maintenance and service friendly. In spite of the compact construction of the guiding system, it is possible to replace the nozzle inserts in order to make rapid change-over possible in case of a batch change.

The nearly totally loss-free air conveying process from fleece funnel to in front of the nip of the calendar disks is characteristic for the air-guided automatic introduction of the fiber fleece into the fiber sliver guiding channel of the textile machine. The air is conveyed without losses from the fleece funnel (which rolls together the drafted fiber fleece and gathers it) to the sliver funnel (which causes the fiber sliver to be compacted before the pair of calendar rollers). In this area, no lateral opening from which the air could escape is made in the guiding channel; in this area only lateral inflow bores (injection bores) which generate and maintain the air suction stream are present.

Because of the air conveying system which is closed up to the nip, the process for automatic introduction of the beginning of the fiber fleece is very economical in air. At the same time, the process is not sensitive to pressure fluctuations of the air used for the introduction and is able to work reliably within a wide range of compressed air.

Slanted introduction in the direction of fiber sliver movement causes the compressed air to become a suction stream on top.

Mechanical threading of a segment of the fiber fleece into the fleece funnel is entirely omitted. The fiber fleece merely has to be reduced to a smaller width at its forward end and the remaining, narrower segment has to be shortened to a predetermined length determined by the weight of the fiber fleece and the length of the fiber channel and the fleece channel from the fleece funnel to the nip. Brief actuation of a compressed-air generator in order to generate a brief compressed-air impulse produces the threading of the narrowed segment of fiber fleece into the fleece funnel and the conveying of this segment before the nip, where a brief rotational impulse of the calendar disks causes the complete threading or the complete introduction of the fiber sliver between the calendar disks.

The compressed-air impulse can be advantageously coupled with a rotational impulse that is slightly offset in time so that the operator needs to depress the push button only once in order to thread the fiber fleece. In the state of the art, a fiber fleece cannot be presented, introduced and be brought into operating position any more easily, rapidly and reliably.

The suction air stream above the point of compressed-air intake is reliably created when the compressed air is introduced at the point of the fiber sliver conveying channel with the smallest diameter. This is the sliver funnel which is installed in close proximity of the calendar disks. A stream of compressed air fed at this point in the direction of the calendar disks reliably produces a suction air stream above the feed point and going up to the fleece funnel, as no air losses occur there. No openings at a right angle to the guiding channel are provided in the entire guiding segment going from the fleece funnel to the sliver funnel which could make it possible for air to escape. The reliable build-up of the suction air stream starting at the forward end of the conveying path and taking effect back to the point of entry of the spread-out fiber fleece—the fleece funnel—makes it possible to avoid the necessity of bringing any additional air flow into this area, as is normally the case in the state of the art, when an inflow of air is provided at the fleece funnel or directly thereafter, while venting is provided at the sliver funnel or directly thereafter.

With the present invention the fiber fleece is thus taken up at its forward end by the air stream and is then pulled in the form of a fiber sliver along the entire fiber sliver channel and is presented directly in front of the calendar disks. The fiber sliver is not "pushed" by compressed air and is de-aired far before the calendar disks.

DETAILED DESCRIPTION OF THE PREFERRED EMBODIMENTS

Figure 1:
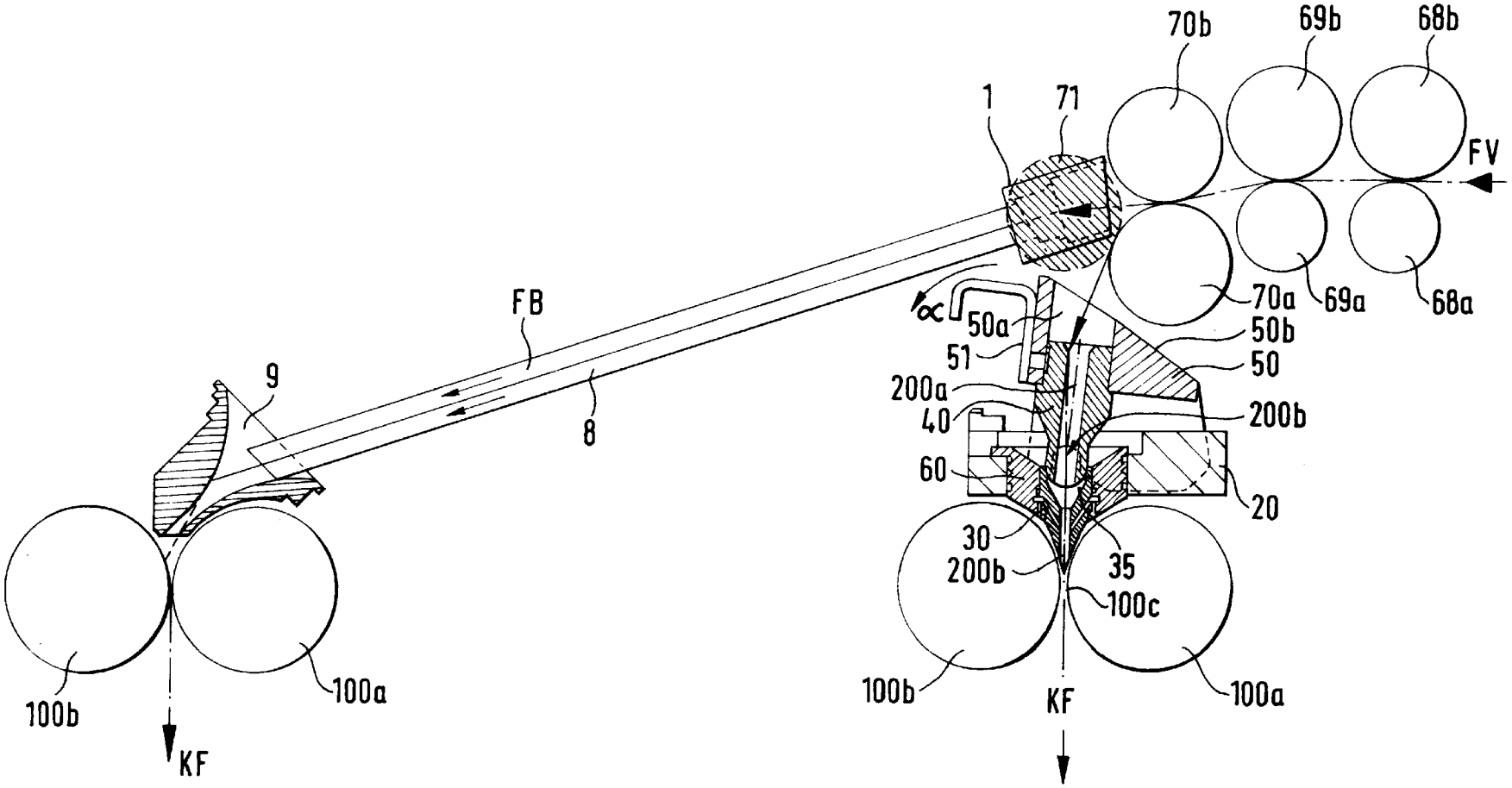
FIG. 1 shows the usual configuration of a fiber sliver guiding system with a long fiber sliver channel (left side of drawing) superimposed on a compact construction according to the invention (right side of drawing) with two nozzle inserts 30, 40, 50 60 connected together, of which two nozzle inserts 40, 50 are able to tilt relative to the other two nozzle inserts 30, 60 which are located on a nozzle holder 20 fixedly installed above the calendar disks 100*a*,100*b*. The superimposed drawing serves to illustrate the shortening of the conveying distance. The deflection roller 71 is part of the compact construction shown on the right side of the drawing.
Figure 3:
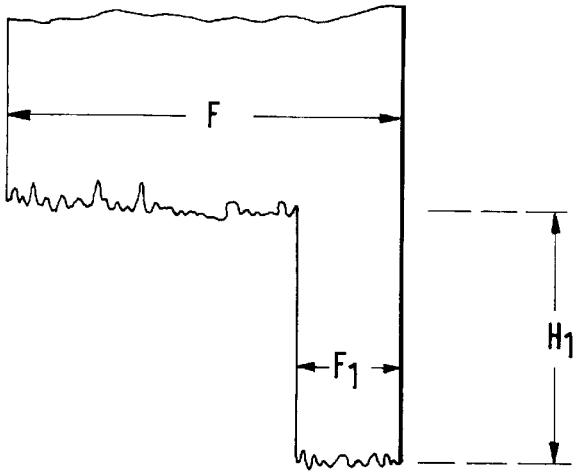
FIG. 3 shows the preparation of the fiber fleece F for introduction into the fleece funnel 50.

Reference will now be made in detail to the presently preferred embodiments of the invention, one or more examples of which are illustrated in the drawings. Each example is provided by way of explanation of the invention, and not meant as a limitation of the invention. In fact, it will be apparent to those skilled in the art that various modifications and variations can be made in the invention without departing from the scope or spirit of the invention.

Figure 2:
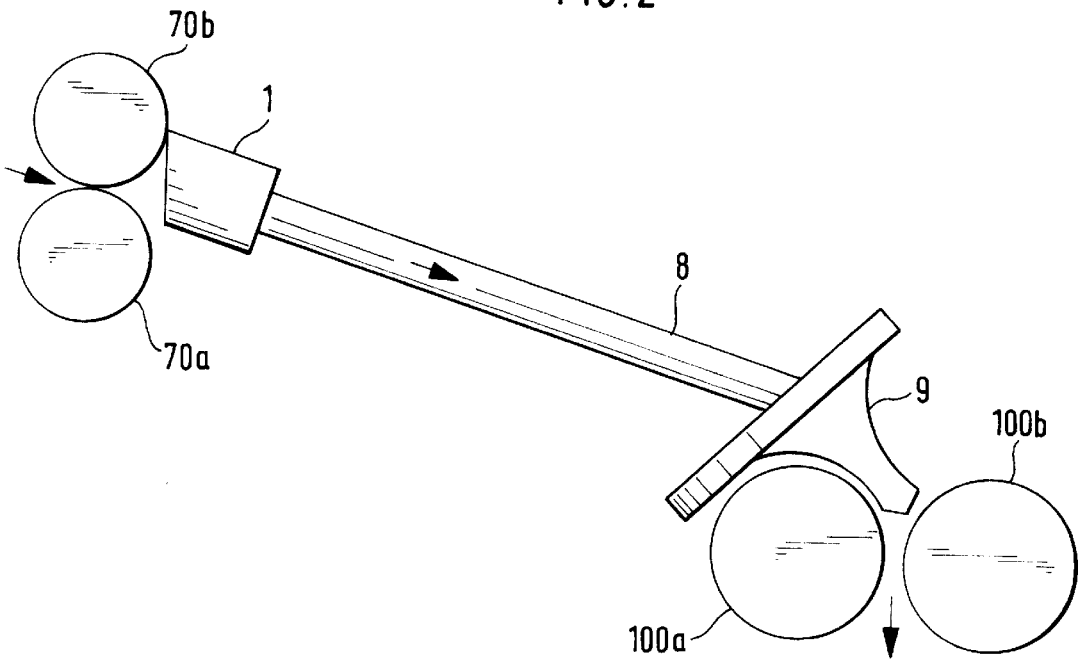
FIG. 2 shows a fiber sliver guiding system according to the state of the art.

The superimposition of FIG. 1 shows the difference with the state of the art which is shown schematically in FIG. 2. The fiber sliver FV which is not yet drafted when it is introduced is introduced in the state of the art via drafting rollers 68*a*, 68*b*, 69*a*, 69*b* and delivery rollers 70*a*, 70*b* by means of a fleece funnel 1 into a long guiding channel 8 which lets out in a sliver funnel 9. The sliver funnel deflects the fiber sliver FB by approximately 90° and into the nip of the calendar with its calendar disks 100*a*, 100*b*. The calendared fiber sliver KF emerges from the calendar in a vertically downward direction and is stored in a depositing device. This fiber sliver guidance is also shown with the same reference numbers in FIG. 1.

An embodiment of the invention shortens the fiber sliver path and makes it possible to omit the fiber sliver channel 8. An additional deflection roller 71 is used which deflects the direction of travel of the fleece FV by approximately 60° and introduces the fiber sliver into a device consisting of several functional elements forming the fiber sliver channel. The first element is the fleece funnel 50 with a ramp surface 50*b* and an immediately following funnel section 50*a* in which the wide, arriving fiber sliver (also called a fiber fleece) folded, doubled and is introduced into a first channel section. The channel section is constituted by an insert 40 which is plugged in on the rear side of the funnel segment 60 and is attached with a screw.

An articulation surface is provided at the forward end of insert 40 and, in the corner position shown in FIG. 1, it makes possible sealing off the guiding channel against the downstream sliver funnel 30.

The articulation surface of the forward, cylindrical segment of the inner insert 40 consists of two constantly curving surface segments tapering towards the rear which engage a matching bearing surface 35 on sliver funnel 30. Swiveling the fleece funnel 50 in direction $\alpha$ into the other end position does not break the radial air-tight seal between fleece funnel and sliver funnel, and air-tight air fiber sliver conveying is obtained in the closed as well as open, swiveled state.

The radial tightness on the articulation surfaces 35 is adjustable. The upper part—above the articulation surface—can be modified for this in axial direction, in particular also in radial direction in its relative position to the lower part. The fixed holder 20 in which the sliver funnel is inserted constitutes the basis for adjustment.

If the fleece funnel 50 is made in two parts—with the insert inserted into the funnel bore of the fleece funnel in a direction opposite to that of fiber sliver movement—the previously mentioned relative adjustment can be made on a grip 51.

The sliver funnel 30 is made in the form of an insert and reaches with a pointed tapered V-shaped end between the calendar disks 100*a*, 100*b* directly to the nip 100*c*. The insert 30 is configured so that it can be inserted axially into a sliver funnel holder 60 and be held there.

The fiber sliver is conveyed through the fleece nozzle 50, the inner insert 40 and the sliver funnel 30 into the guiding channel up to nip 100*c*, and for this the fleece 50 is swiveled out. The manually narrowed fiber fleece part F1 is held into the funnel opening 50*a* and is sucked in via injection bores 34*a*, 34*b*, 64*a*, 64*b* on the sliver funnel. A brief suction stream of a magnitude in time of approximately 500 m/sec is sufficient in order to convey the narrowed fiber sliver F1 with a minimal expenditure of compressed air until it is in front of the nip 100*c*, since the articulation bearing surface 35 and the bearing surface of the inner insert 40 are radially sealed off. Mechanical insertion assistance is not required.

In order to introduce first the segment F1 of the fiber fleece, and with it the full width F of the fiber fleece, through the nip in the form of an reshaped fiber sliver, a brief rotational impulse is imparted the calendar disk. It is able to shut itself off automatically after a predetermined suction time, may be superimposed on it, or can be shut off separately, manually.

Figure 4A:
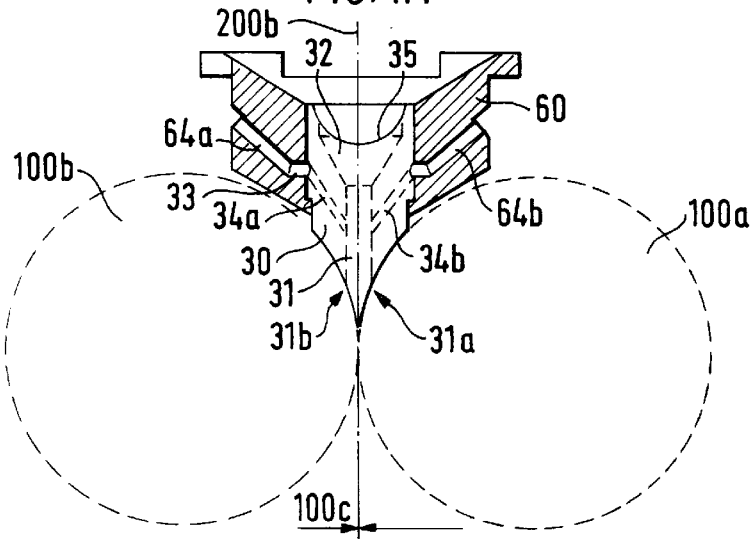
FIGS. 4*a*, 4*b* and 4*c* show an enlargement of the sliver funnel 30 of FIG. 1 which feeds the air without losses to a point directly at the nip 100*c*.

The form of the sliver funnel 30 is clearly shown in FIG. 4*a*, and the direction and placement of the injection bores 34*a*, 34*b* in the sliver funnel are also shown in enlarged form here. The bores let out into a cylindrical channel 31 constituting the forward end of the fiber sliver channel. The cylindrical segment 31 widens over a conical segment 32 to the diameter of the fiber sliver channel which is determined by the inner insert 40.

The slanted injection bores 34*a*, 34*b* may form an angle of approximately 45° with the axis 200*b* of the sliver funnel insert 30, and they may be parallel-offset in order to impart a twist to the introduced fiber sliver as well as additional strength.

A sliver funnel holder 60 is provided with a centered, approximately cylindrical opening into which the sliver funnel insert 30 is inserted. An annular channel 33 open to the inside extends in circumferential direction in the cylindrical opening and can be supplied with compressed air by two or more cylindrical bores 64*a*, 64*b*. Extending from the annular channel, the compressed air introduced from the outside is introduced into the previously mentioned slanted injection bores 34*a*, 34*b* when the sliver funnel insert 30 is inserted and lets out in the cylindrical segment 31 of the fiber sliver channel which is located immediately against the nip 100*c*.

The forward end of insert 30 is V-shaped and has slightly curved V legs which are adapted to the surface curvature of the calendar rollers 100*a*, 100*b*. The sliver funnel insert 30 can thus be inserted directly into the slightly curved, narrowing intermediate space between the calendar disks and the cylindrical segment 31 ends with its forward end directly in front of the nip 100*c*. This becomes especially clear in the side view of FIG. 4*c*. The diameter d of the cylindrical guiding channel 31 is shown here. The forward, cylindrical segment of the sliver funnel insert 30 is provided here with two surface segments 31*a*, 31*b* which taper laterally in an upward direction and have the curvature shown in FIG. 4*a*. A V shaped opening end results in function of the pointed tapered sliver funnel insert 30 and the cylindrical bore 31 with constant diameter, whereby the air flowing through the injection bores emerges from this opening and conveys the fleece up to the nip.

Because of the width b of the calendar disks in relation to the clearly smaller diameter d of the cylinder guiding channel, the air cannot or only barely or slowly escapes laterally, so that the major portion of the flowing air is conveyed up to the nip and deposits the fiber fleece it carries along at that point.

Figure 4B:
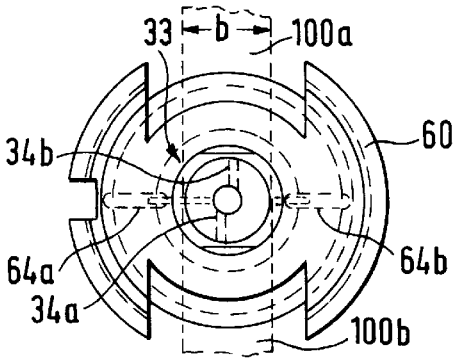
Figure 4C:
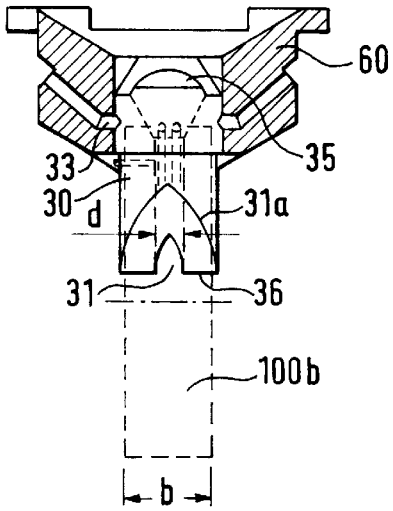

FIG. 4*b* shows a top view in which the width b of the two calendar disks 100*a*, 100*b* can be seen. Also shown are the injection bores 64*a*, 64*b* as feed channels going to the annular channel 33, as well as the parallel-offset, slanted injection channels 34*a*, 34*b* in insert 30. At least 2 injection channels are present, so that the fiber sliver is centered and is at the same time imparted a twist.

The compressed air can be used at a pressure of 4 bar, for example, but is adapted to a channel diameter of approximately 3.8 mm in the sliver funnel and approximately 8 mm in the insert 40 of the fleece funnel 50. Tests have shown that even a compressed air blast of approximately 500 m/sec duration is sufficient for secure introduction of the forward end F1 of the fiber sliver up to the nip 100*c*. The length H1 of the manually narrowed fiber fleece is here adapted to the distance between the fleece funnel 50 and the nip 100*c*, and thereby to the length of the air-tight fiber sliver channel.

The above-mentioned annular channel 3 may also be made on the insert 30, e.g. by a surrounding notch, in an alternative variant (not shown in the drawings).

Figure 5B:
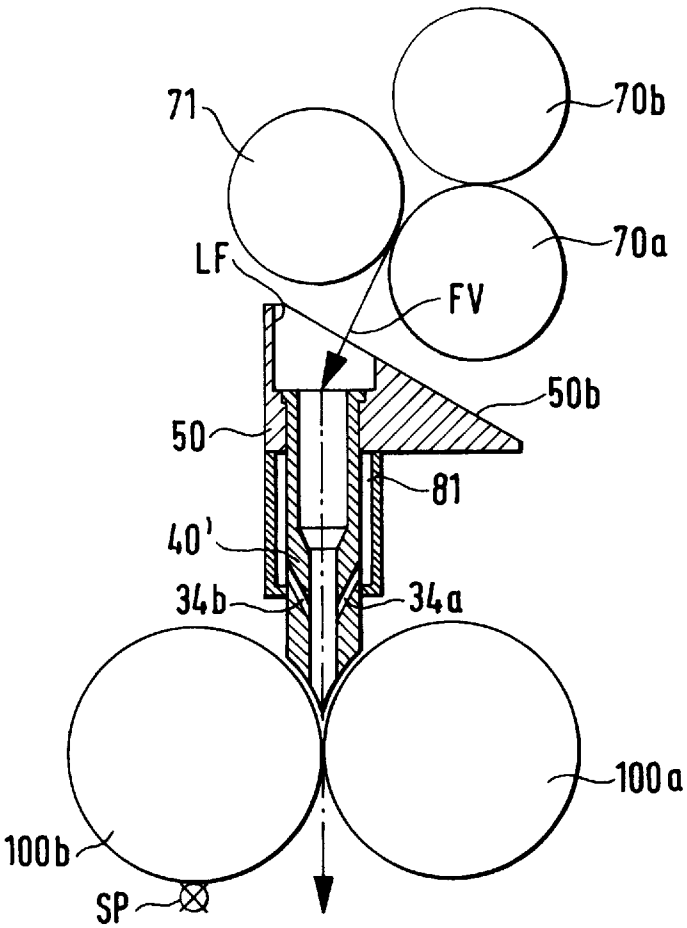
FIGS. 5*a* and 5*b* show the swiveling of a fleece funnel with nozzle insert 40' and a calendar disk 100*b* around a common pivot point SP.
Figure 5A:
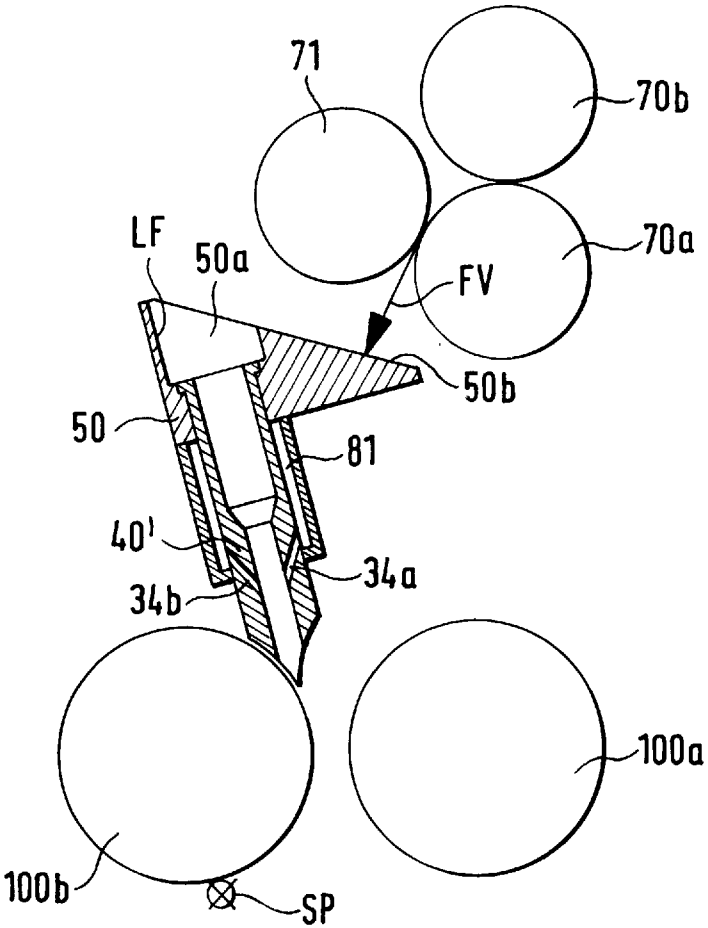

FIG. 5*a* shows a fleece funnel 50 with a nozzle insert 40'. The insert 40' is made in one piece. The insert 40' has a fiber sliver guiding system designed so that it corresponds in a first segment to the fiber guiding system of an insert 40 and in the following segment to the fiber sliver guiding system of a sliver funnel 30 (as in FIG. 4*a*). FIG. 5*a* shows such an insert 40' in preparation position, i.e. in a position for the presentation of the fiber fleece into the funnel area 50*a*. This position shown in FIG. 5*a* is also assumed by the insert 40' when a backup of fiber fleece has occurred.

The insert 40' can be replaced much quicker than the insert 40 and the sliver funnel 30 as shown in FIG. 1. Readjustment or alignment tasks can be omitted because of the compact (one-piece) configuration of the insert 40'. Furthermore no air-tight swiveling articulation is necessary.

In an advantageous embodiment, a calendar disk 100*b* and the insert 40' are located in a common support or holder (not shown). The support swivels around a pivot point SP. It is possible to swivel the calendar disk 100*b* and the insert 40' around the common pivot point SP. Since insert 40' is connected to the fleece funnel 50, both are therefore swiveled. For the sake of simplification only swiveling of insert 40' is mentioned hereinafter. Swiveling provides better access to the operator and allows him to see the insert 40' better. A conveyed fiber fleece can therefore be presented manually in the funnel area 50*a* in order to thread the beginning of the fiber fleece. The fiber fleece is formed by the fleece funnel into a fiber sliver and is immediately conveyed between the open calendar disks 100*a*, 100*b*. For the beginning of stationary operation the insert 40' and the calendar disks 100*a*, 100*b* are swiveled back into position as shown in FIG. 5*b*. This is the position for stationary operation (operating position) of insert 40'.

Another embodiment makes it possible to swivel insert 40' separately and to swivel the calendar disk 100*b* separately around pivot point SP. This allows the calendar disk 100*b* to remain in closed position during sliver introduction. Only the insert 40' swivels for the introduction of the sliver start. If it is necessary to open the calendar disks, this can be done separately.

It is also possible to have an embodiment in which the insert 40' does not swivel but is fixed as shown in FIG. 5*b*. In such a design, the guiding surface LF of the fleece funnel

50 must be pivotable. A pivot axis must be advantageously provided in the lower area of the guiding surface so that said guiding surface LF can be swiveled away only from the funnel area 50*a*. This makes it possible to swivel guiding surface LF away in case of fiber fleece back-up, so that said fleece is able to move out of the funnel area 50*a*. Furthermore, the operator is afforded a view of the funnel area 50 thanks to the ability of guiding surface LF to swivel. In this embodiment, a calendar disk 100 can furthermore be supported so as to be able to swivel relative to a pivot point SP.

It will be apparent to those skilled in the art that various modifications and variations can be made in the present invention without departing from the scope and spirit of the invention. For example, features illustrated or described as part of one embodiment may be used on another embodiment to yield a still further embodiment. It is intended that the present invention cover such modifications and variations as come within the scope of the appended claims and their equivalents.

We claim:

1. A sliver funnel for removable insertion in a fiber fleece guide system downstream of a fleece funnel wherein the guide system receives a fiber fleece from delivery rollers of a textile machine and delivers the fiber fleece to a nip of a pair of calendar devices, said sliver funnel comprising:

a conically tapered section that tapers into a substantially cylindrical segment in a direction of conveyance of said fiber fleece, said substantially cylindrical segment having a front end configured to be adjacent said nip of said calendar;

at least one high pressure air bore defined in said sliver of funnel and configured to be in communication with a high pressure air source in said fiber fleece guide system, said at least one air bore disposed so as to direct high pressure air substantially into said substantially cylindrical segment operably downstream of said conically tapered section to draw said fiber fleece through said sliver funnel, wherein said high pressure air vents substantially only from said front end of said funnel;

means for mating said sliver funnel with said fleece funnel in a substantially air tight manner; and means for removably fixing said sliver funnel in said guide system.

2. The sliver funnel as in claim 1, comprising at least two said high pressure air bores disposed to direct said high pressure air into said substantially cylindrical segment, said at least two high pressure air bores slanted with respect to a longitudinal axis of said substantial cylindrical segment so as to direct said high pressure air towards said front end of said sliver funnel.

3. The sliver funnel as in claim 2, wherein said at least two high pressure air bores are disposed so as to impart a twist to the fiber fleece conveyed through said substantially cylindrical segment.

4. The sliver funnel as in claim 1, wherein said front end of said substantially cylindrical segment is configured as a point disposed to extend towards said nip of said pair of calendar devices.

5. The sliver funnel as in claim 4, wherein said point is defined by curved opposing side segments of said substantially cylindrical segment, said curved opposing side segments having a curvature generally matching that of said pair of calendar devices.

6. The sliver funnel as in claim 5, wherein said point has a width generally matching that said pair of calendar devices.

7. The sliver funnel as in claim 1, comprising mating surfaces for engagement with complimentary surfaces in a holder device in said fiber fleece guide system so that said sliver funnel is removable from said fiber fleece guide system.

* * * * *